US009269292B2

(12) United States Patent
Koh

(10) Patent No.: US 9,269,292 B2
(45) Date of Patent: Feb. 23, 2016

(54) METHOD OF SETTING TARGET LOCATIONS FOR REDUCING IMAGE STICKING, ORGANIC LIGHT EMITTING DISPLAY DEVICE, AND METHOD OF DRIVING THE SAME

(71) Applicant: Byung-Sik Koh, Yongin (KR)

(72) Inventor: Byung-Sik Koh, Yongin (KR)

(73) Assignee: SAMSUNG DISPLAY CO., LTD., Yongin, Gyunggi-Do (KR)

( * ) Notice: Subject to any disclaimer, the term of this patent is extended or adjusted under 35 U.S.C. 154(b) by 382 days.

(21) Appl. No.: 13/779,800

(22) Filed: Feb. 28, 2013

(65) Prior Publication Data

US 2013/0257884 A1 Oct. 3, 2013

(30) Foreign Application Priority Data

Apr. 3, 2012 (KR) ..... 10-2012-0034376

(51) Int. Cl.
*G09G 3/32* (2006.01)

(52) U.S. Cl.
CPC ..... *G09G 3/3208* (2013.01); *G09G 3/3225* (2013.01); *G09G 2300/0866* (2013.01); *G09G 2320/048* (2013.01); *G09G 2320/0626* (2013.01)

(58) Field of Classification Search
CPC ..... G06T 1/60; G06T 1/20; G06T 15/005; G06T 9/00; G06T 15/405; G06T 15/503; G06T 11/40; G06T 15/40; G06T 2200/28
See application file for complete search history.

(56) References Cited

U.S. PATENT DOCUMENTS

| | | | | |
|---|---|---|---|---|
| 7,839,096 | B2 | 11/2010 | Kim et al. | |
| 2008/0042968 | A1 | 2/2008 | Oh | |
| 2008/0170024 | A1* | 7/2008 | Song et al. | 345/96 |
| 2010/0188375 | A1 | 7/2010 | Lee et al. | |
| 2011/0122119 | A1* | 5/2011 | Bae et al. | 345/211 |
| 2011/0157198 | A1* | 6/2011 | Vasquez et al. | 345/531 |
| 2011/0210958 | A1* | 9/2011 | Yoo et al. | 345/214 |
| 2012/0056916 | A1* | 3/2012 | Ryu et al. | 345/691 |

FOREIGN PATENT DOCUMENTS

| | | | |
|---|---|---|---|
| KR | 10-2007-0080020 | A | 8/2007 |
| KR | 10-2008-0017280 | A | 2/2008 |
| KR | 10-2010-0087869 | A | 8/2010 |

* cited by examiner

*Primary Examiner* — Olga Merkoulova
(74) *Attorney, Agent, or Firm* — Lee & Morse, P.C.

(57) ABSTRACT

A method of setting target locations for reducing image sticking is provided. According to the method, a plurality of images, each of the images being displayed during each frame by an organic light emitting display device are acquired. The target locations at which image sticking frequently occurs are set by comparing the images. Image data corresponding to the target locations are stored in a memory unit. A plurality of pixel circuits may simultaneously emit light in the organic light emitting display device.

20 Claims, 9 Drawing Sheets

METHOD OF SETTING TARGET LOCATIONS FOR REDUCING IMAGE STICKING, ORGANIC LIGHT EMITTING DISPLAY DEVICE, AND METHOD OF DRIVING THE SAME

CROSS-REFERENCE TO RELATED APPLICATION(S)

This application claims priority under 35 USC §119 to Korean Patent Applications No. 10-2012-0034376, filed on Apr. 3, 2012, in the Korean Intellectual Property Office (KIPO), the contents of which are incorporated herein in its entirety by reference.

BACKGROUND

1. Field

Example embodiments relate generally to an organic light emitting display device. More particularly, embodiments of the inventive concept relate to an organic light emitting display device capable of reducing, ideally eliminating, image sticking when images are displayed.

2. Description of the Related Art

According to a simultaneous emission technique for driving an organic light emitting display device, data may be sequentially scanned by each scan-line during a scan period, and then all pixel circuits may simultaneously emit light based on power voltages (e.g., ELVDD and ELVSS) during an emission period. In case of a large-screen organic light emitting diode (OLED) television having an organic light emitting display device, it is important to reduce, ideally eliminate, image sticking and to reduce power consumption.

Generally, conventional image sticking reduction techniques may store a sum-value generated by summing all image data of one frame, and then may reduce luminance of an organic light emitting display device if a sum-value is not changed for a predetermined time (i.e., if a sum-value of each frame substantially has the same value for a predetermined time). In addition, the conventional image sticking reduction technique may reduce luminance of the organic light emitting display device by reducing data voltages.

However, a gamma distortion may be caused in the organic light emitting display device when the conventional image sticking reduction technique reduces the data voltages based on a sum-value generated by summing all image data of one frame. Accordingly, the conventional image sticking reduction technique is not suitable for an organic light emitting display device that employs a simultaneous emission technique.

SUMMARY

Some example embodiments provide a method of setting target locations for reducing image sticking capable of automatically or manually setting the target locations in which image sticking frequently occurs in an organic light emitting display device.

Some example embodiments provide a method of driving an organic light emitting display device capable of controlling an emission period of the organic light emitting display device based on a pulse width modulation (PWM) signal to reduce, ideally to eliminate, image sticking and to reduce power consumption.

Some example embodiments provide an organic light emitting display device that is driven by the method of driving an organic light emitting display device.

According to some example embodiments, a method of setting target locations for reducing image sticking may include acquiring a plurality of images, each of the images being displayed during each frame by an organic light emitting display device, setting the target locations at which image sticking frequently occurs by comparing the images, and storing image data corresponding to the target locations in a memory unit. Here, a plurality of pixel circuits may simultaneously emit light in the organic light emitting display device.

In example embodiments, the target locations may be manually set based on the images.

In example embodiments, the target locations may be automatically set based on pixel information.

In example embodiments, the pixel information may include information related to color types of the images, information related to gradation levels of the images, and information related to whether the images are still-images or moving-images.

In example embodiments, the memory unit may correspond to a frame memory device or a field programmable gate array (FPGA).

According to some example embodiments, a method of driving an organic light emitting display device may include setting the target locations at which image sticking frequently occurs by analyzing a plurality of images, each of the images being displayed during each frame by an organic light emitting display device, storing a sum-value that is generated by summing image data corresponding to the target locations during one frame in a memory unit, setting a data change threshold value, comparing a variation of the sum-value with the data change threshold value, reducing an emission period of the organic light emitting display device when the variation of the sum-value is smaller than the data change threshold value, resetting the emission period of the organic light emitting display device when the variation of the sum-value is greater than the data change threshold value, and storing a new sum-value that is generated by summing image data corresponding to the target locations during a next frame in the memory unit after the emission period of the organic light emitting display device is reset.

In example embodiments, power consumption of the organic light emitting display device may be reduced when the emission period of the organic light emitting display device is reduced.

In example embodiments, image sticking may be reduced when the emission period of the organic light emitting display device is reset to an initial emission period.

In example embodiments, reducing the emission period of the organic light emitting display device may include setting a first check time, a second check time, a third check time, a first reduction emission period, a second reduction emission period, and a minimum emission period, the first check time being greater than the second check time, the second check time being greater than the third check time, the initial emission period being greater than the first reduction emission period, the first reduction emission period being greater than the second reduction emission period, the second reduction emission period being greater than the minimum emission period, changing the emission period of the organic light emitting display device to the first reduction emission period when the variation of the sum-value is smaller than the data change threshold value for the first check time, changing the emission period of the organic light emitting display device to the second reduction emission period when the variation of the sum-value is smaller than the data change threshold value for the second check time, and changing the emission period of the organic light emitting display device to the minimum reduction emission period when the variation of the sum-value is smaller than the data change threshold value for the third check time.

In example embodiments, the emission period of the organic light emitting display device may be proportional to a length of a low level period of a second power voltage that is provided to the organic light emitting display device. In addition, a length of the low level period of the second power voltage may be controlled by a pulse width modulation (PWM) signal.

In example embodiments, a variation of the new sum-value may be compared with the data change threshold value during the next frame when the variation of the sum-value is greater than the data change threshold value during the one frame.

According to some example embodiments, an organic light emitting display device may include a display panel having a plurality of pixel circuits, a scan driver that sequentially provides a scan signal to the pixel circuits via a plurality of scan-lines, a data driver that provides a data signal to the pixel circuits via a plurality of data-lines based on the scan signal, a memory unit that sets target locations for reducing image sticking based on a plurality of images that are displayed on the display panel, and that stores a sum-value that is generated by summing image data corresponding to the target locations, a PWM controller that generates a pulse width modulation (PWM) signal, an on-duty ratio of the PWM signal being determined based on a comparison result that is generated by comparing a variation of the sum-value with a data change threshold value, a power supply unit that generates a first power voltage and a second power voltage to simultaneously provide the first power voltage and the second power voltage to the pixel circuits, and a timing controller that controls the scan driver, the data driver, the PWM controller, and the power supply unit. Here, a length of a low level period of the second power voltage may be proportional to the on-duty ratio of the PWM signal, and the pixel circuits may simultaneously emit light in the low level period of the second power voltage.

In example embodiments, the target locations may be manually set based on the images, or automatically set based on pixel information. In addition, the pixel information may include information related to color types of the images, information related to gradation levels of the images, and information related to whether the images are still-images or moving-images.

In example embodiments, an emission period of the organic light emitting display device may be proportional to a length of the low level period of the second power voltage.

In example embodiments, the PWM controller may reduce the on-duty ratio of the PWM signal when the variation of the sum-value is smaller than the data change threshold value.

In example embodiments, the PWM controller may reset the on-duty ratio of the PWM signal to an initial on-duty ratio when the variation of the sum-value is greater than the data change threshold value.

In example embodiments, the memory unit may store a new sum-value that is generated by summing image data corresponding to the target locations during a next frame when the variation of the sum-value is greater than the data change threshold value.

In example embodiments, the data change threshold value may correspond to a constant that is determined according to a type of the images displayed on the display panel.

In example embodiments, the memory unit may correspond to a frame memory device that stores the image data for the display panel.

In example embodiments, luminance of the display panel may be reduced when the emission period of the display panel is reduced.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Figure 1:
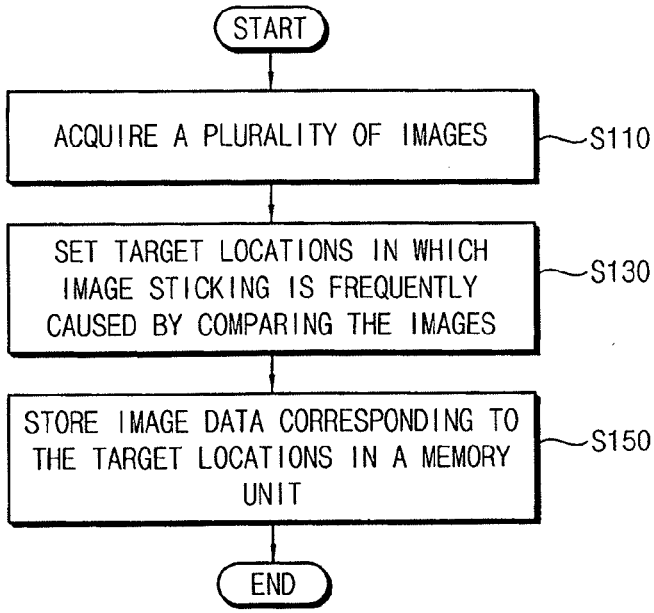
FIG. 1 is a flow chart illustrating a method of setting target locations for reducing image sticking according to example embodiments.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a flow chart illustrating a method of setting target locations for reducing, ideally eliminating, image sticking according to example embodiments.

Referring to FIG. 1, a plurality of images, each being displayed during each frame by an organic light emitting display device, may be acquired (Step S110). Then, the target locations in which image sticking frequently occurs in the organic light emitting display device may be set by comparing the images (Step S130). That is, the target locations may be selected by comparing the images that are displayed by the organic light emitting display device.

In one example embodiment, the target locations may be manually set by a user (or an operator) based on the images. In addition, the number of the target locations may also be manually set by a user based on the images. For example, the user may determine whether the images displayed by the organic light emitting display device are still-images or moving-images, and may set the target locations in which image sticking frequently occurs by distinguishing locations in which image changes are frequently performed from locations in which image changes are infrequently performed.

In another example embodiment, the target locations may be automatically set based on pixel information. In addition, the number of the target locations may also be automatically set based on the pixel information. Here, the pixel information may include information related to color types of the images, information related to gradation levels of the images, and information related to whether the images are still-images or moving-images. Thus, as the images displayed by the organic light emitting display device are changed, the target locations to which an image sticking reduction algorithm is to be applied may be automatically changed.

Next, image data corresponding to the target locations may be stored in a memory unit (Step S150). According to conventional image sticking reduction techniques, all image data of one frame (i.e., all image data corresponding to entire display region of a display panel) are stored in a memory device. Hence, at least two memory devices are required to store (i.e., write) and read the image data. However, since the method of FIG. 1 sets the target locations in which image sticking frequently occurs in the organic light emitting display device, the image data corresponding to only the target locations may be stored in one memory device (i.e., the memory unit) such as a frame memory device or a field programmable gate array (FPGA).

Figure 2:
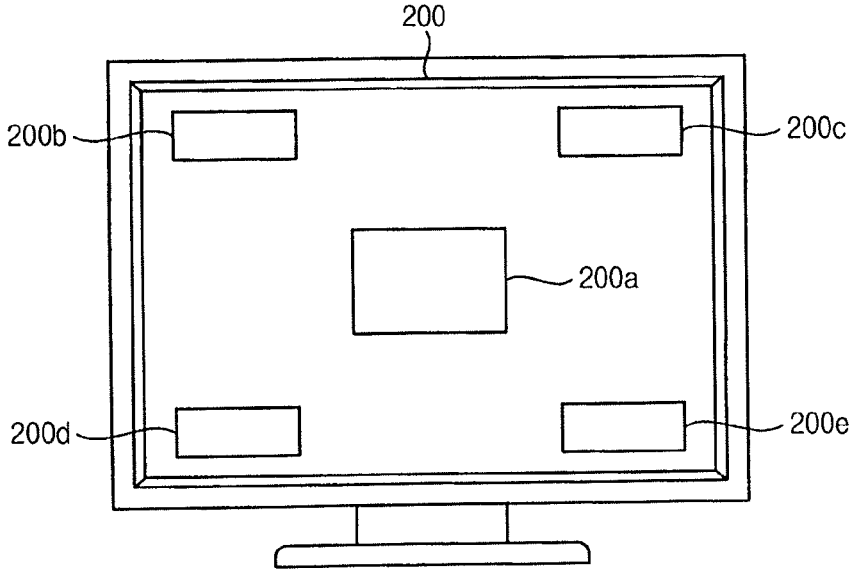
FIG. 2 is a diagram illustrating an example in which a method of FIG. 1 is applied to an organic light emitting display device.

FIG. 2 is a diagram illustrating an example in which a method of FIG. 1 is applied to an organic light emitting display device.

Figure 3:
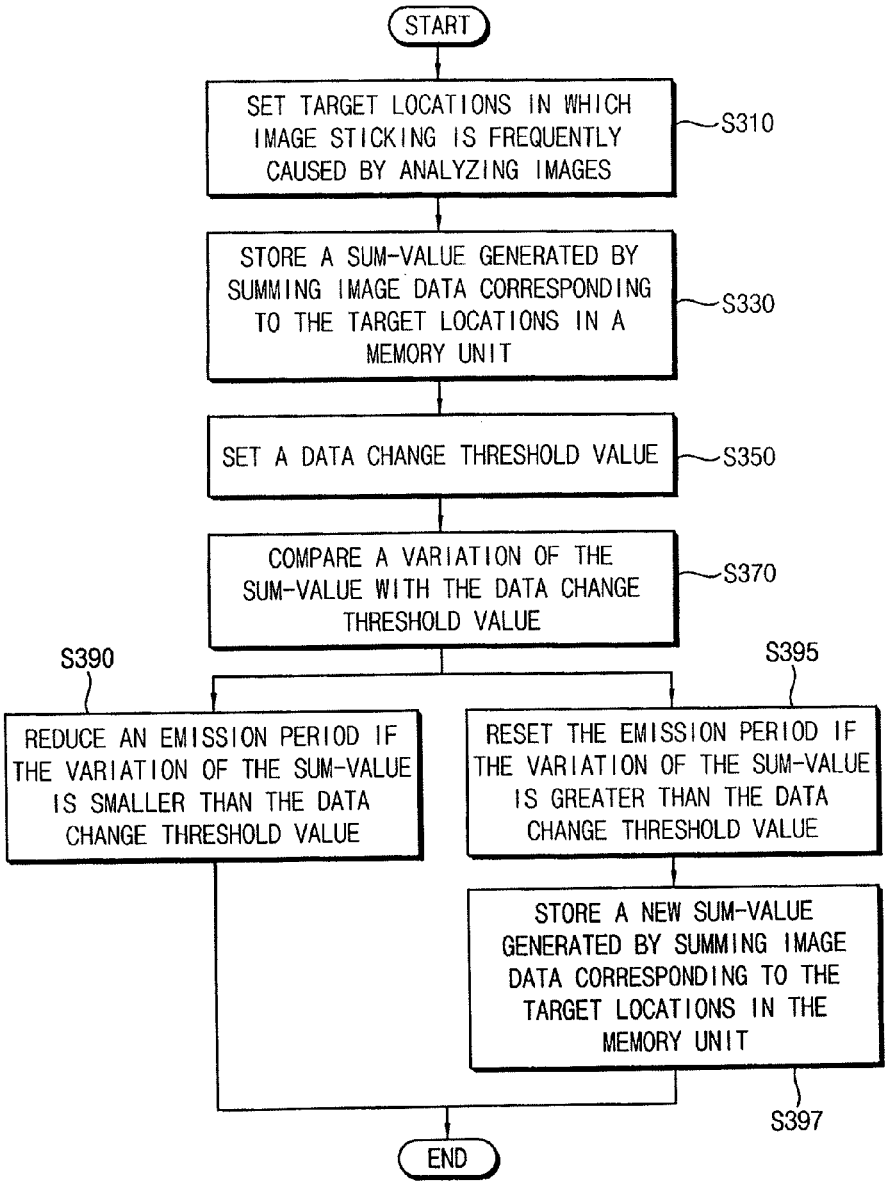
FIG. 3 is a flow chart illustrating a method of driving an organic light emitting display device according to example embodiments.
Figure 4:
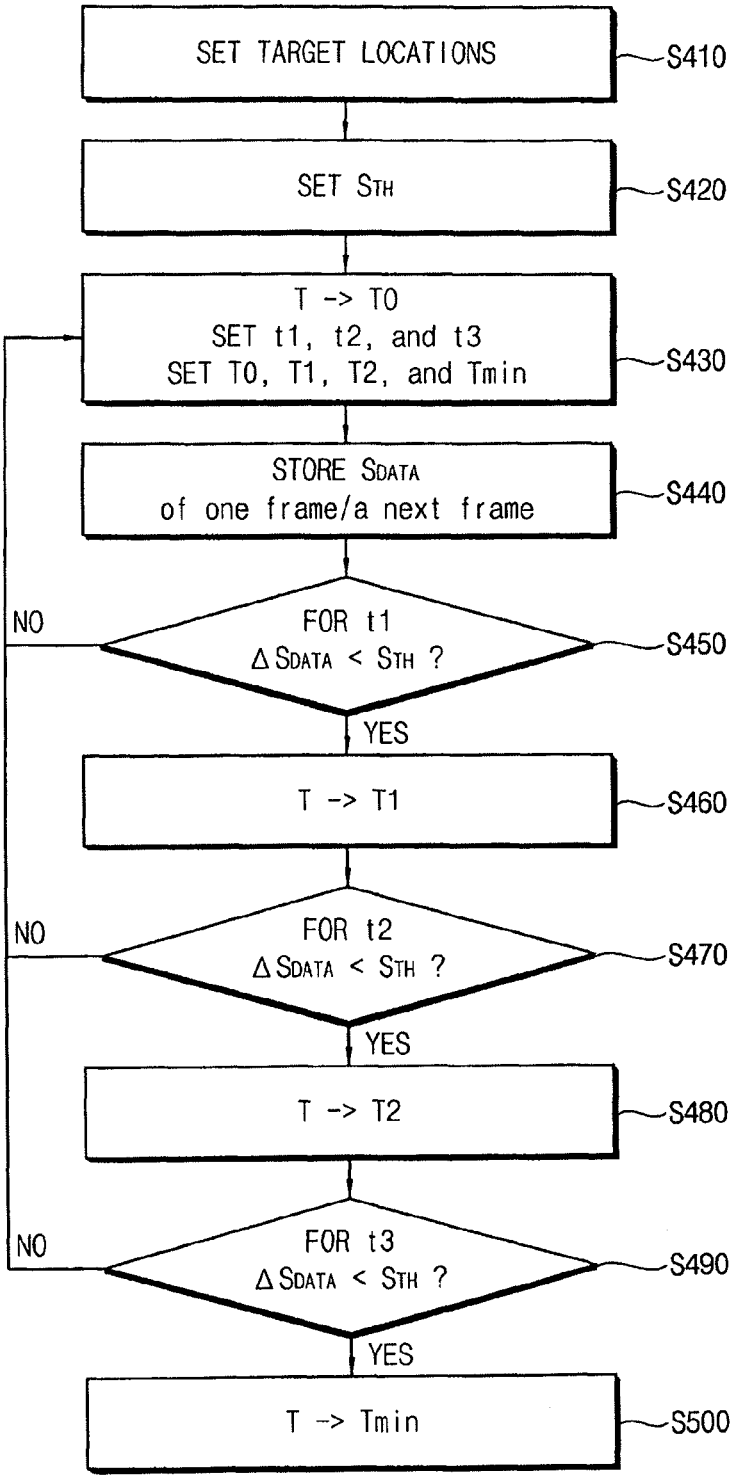
FIG. 4 is a flow chart illustrating an image sticking reduction algorithm according to example embodiments.

Referring to FIGS. 1 and 2, the target locations 200*a* through 200*e* for reducing, ideally eliminating, the image sticking may be set on a display region 200 (i.e., a display panel) of the organic light emitting display device. As described above, the target locations 200*a* through 200*e* may be set by analyzing the images displayed on the display region 200. For example, the image data may be infrequently changed in some display regions on which information messages are displayed. In this case, an image sticking reduction algorithm may not be applied to the display regions. On the other hand, the image data may be frequently changed in other display regions (e.g., a central location 200*a*). In this case, an image sticking reduction algorithm may be applied to the display regions. Hereinafter, it is assumed that the target locations 200*a* through 200*e* are set (i.e., selected) for reducing the image sticking. With reference to FIGS. 3 and 4, a method of applying the image sticking reduction algorithm to the target locations 200*a* through 200*e* will be described in detail.

FIG. 3 is a flow chart illustrating a method of driving an organic light emitting display device according to example embodiments.

Referring to FIG. 3, target locations in which image sticking frequently occurs in the organic light emitting display device may be set by analyzing images displayed by the organic light emitting display device (Step S310). Here, each of the images may be displayed during each frame. Since the Step S310 is performed by the method of FIG. 1, duplicated descriptions will be omitted below.

During one frame, a sum-value may be generated by summing image data of the one frame corresponding to the target locations, and the sum-value may be stored in a memory unit (Step S330). In addition, a data change threshold value may be set (Step S350). Here, the data change threshold value may be a constant that is determined according to a type of the images that are displayed on a display panel. For example, if the images are moving-images, image changes may be frequently performed (i.e., a variation of the image data are relatively great). In this case, the data change threshold value may be set to be a relatively small. As a result, a sticking image reduction ratio is increased so that a clear image may be obtained. However, power consumption of the organic light emitting display device may be increased. On the other hand, if the data change threshold value is set to be a relatively great, power consumption of the organic light emitting display device may be reduced by reducing luminance for the images having a relatively small variation. However, the sticking image reduction ratio may be reduced.

A variation of the sum-value may be compared with the data change threshold value (Step S370). Here, if the variation of the sum-value is smaller than the data change threshold value, an emission period of the organic light emitting display device may be reduced (Step S390). On the other hand, if the variation of the sum-value is greater than the data change threshold value, an emission period of the organic light emitting display device may be reset (Step S395). In addition, during a next frame, a new sum-value may be generated by summing image data of the next frame corresponding to the target locations, and the new sum-value may be stored in the memory unit (Step S397).

In example embodiments, if a variation of the image data corresponding to the target locations is relatively small (i.e., if the variation of the sum-value is smaller than the data change threshold value), an emission period of the organic light emitting display device may be reduced. As a result, the organic light emitting display device may consume low power because luminance of the organic light emitting display device can be reduced. As described above, conventional image sticking reduction techniques reduce luminance of the organic light emitting display device by reducing data voltages. However, the present inventive concept may reduce luminance of the organic light emitting display device by reducing an emission period of the organic light emitting display device. Therefore, a gamma distortion may be prevented.

On the other hand, if a variation of the image data corresponding to the target locations is relatively great (i.e., if the variation of the sum-value is greater than the data change threshold value), an emission period of the organic light emitting display device may be reset to an original emission period of the organic light emitting display device. Then, during a next frame, a new sum-value may be generated by summing image data of the next frame corresponding to the target locations, and the new sum-value may be stored in the memory unit. Generally, a probability of the image sticking increases as a variation in image data between frames increases. Therefore, the present inventive concept may reduce, ideally eliminate, image sticking by increasing an emission period of the organic light emitting display device. Subsequently, the same process may be repeated for the target locations by calculating a new sum-value of image data of a next frame. In this way, the organic light emitting display device of a large-screen organic light emitting diode (OLED) television may reduce power consumption, and may efficiently reduce image sticking.

In example embodiments, the organic light emitting display device may employ a simultaneous emission technique. Namely, a plurality of pixel circuits may simultaneously emit light in the organic light emitting display device. In example embodiments, a method of driving the organic light emitting display device may control an emission period of the organic light emitting display device based on a pulse width modulation (PWM) signal. Thus, the method of driving the organic light emitting display device may implement an image sticking reduction algorithm that is suitable for a simultaneous emission technique. The image sticking reduction algorithm for the method of driving the organic light emitting display device will be described in detail with reference to FIG. 4.

FIG. 4 is a flow chart illustrating an image sticking reduction algorithm according to example embodiments. Here, the image sticking reduction algorithm of FIG. 4 is only an example of numerous image sticking reduction algorithms that may be applied to the method of FIG. 3.

Referring to FIG. 4, target locations (i.e., locations to which the image sticking reduction algorithm is to be applied) may be set (Step S410). Since the Step S410 is performed by the method of FIG. 1, detailed description thereof will not be repeated. Then, a data change threshold value STH may be set (Step S420). Here, the data change threshold value STH may be a constant that is determined according to a type of the images displayed on a display panel. Next, an emission period T of an organic light emitting display device may be set to be an initial emission period T0 (Step S430). The initial emission period T0 is the longest emission period (i.e., a maximum emission period).

In one example embodiment, when the initial emission period T0 is set, other constants may also be set. That is, a first check time t1, a second check time t2, and a third check time t3 may be set, and a first reduction emission period T1, a second reduction emission period T2, and a minimum emission period Tmin may be set. Here, the first check time t1 is longer than the second check time t2, and the second check time t2 is longer than the third check time t3. In addition, the initial emission period T0 is longer than the first reduction emission period T1, the first reduction emission period T1 is longer than the second reduction emission period T2, and the second reduction emission period T2 is longer than the minimum emission period Tmin.

Next, a sum-value SDATA may be generated by summing image data corresponding to the target locations, and the sum-value SDATA may be stored (Step S440). In one example embodiment, the sum-value SDATA may be stored in a memory unit that is implemented with a frame memory device or a field programmable gate array (FPGA).

According to a first check operation, a variation ΔSDATA of the sum-value SDATA may be compared with a data change threshold value STH for the first check time t1 (Step S450). Here, when the variation ΔSDATA of the sum-value SDATA is smaller than the data change threshold value STH, an emission period T of the organic light emitting display device may be changed to the first reduction emission period T1 (Step S460). On the other hand, when the variation ΔSDATA of the sum-value SDATA is greater than the data change threshold value STH, an emission period T of the organic light emitting display device may be reset to be the initial emission period T0 (Step S430).

According to a second check operation, the variation ΔSDATA of the sum-value SDATA may be compared with the data change threshold value STH for the second check time t2 (Step S470). Here, when the variation ΔSDATA of the sum-value SDATA is smaller than the data change threshold value STH, an emission period T of the organic light emitting display device may be changed to the second reduction emission period T2 (Step S480). On the other hand, when the variation ΔSDATA of the sum-value SDATA is greater than the data change threshold value STH, an emission period T of the organic light emitting display device may be reset to the initial emission period T0 (Step S430).

According to a third check operation, the variation ΔSDATA of the sum-value SDATA may be compared with the data change threshold value STH for the third check time t3 (Step S490). Here, when the variation ΔSDATA of the sum-value SDATA is smaller than the data change threshold value STH, an emission period T of the organic light emitting display device may be changed to the minimum emission period Tmin (Step S500). On the other hand, when the variation ΔSDATA of the sum-value SDATA is greater than the data change threshold value STH, an emission period T of the organic light emitting display device may be reset to the initial emission period T0 (Step S430).

As described above, when the variation ΔSDATA of the sum-value SDATA is relatively small, an emission period T of the organic light emitting display device may be reduced. Thus, power consumption of the organic light emitting display device may be reduced. That is, since an emission period T of the organic light emitting display device is proportional to luminance of the organic light emitting display device, and power consumption of the organic light emitting display device may be reduced as an emission period T of the organic light emitting display device is reduced. In addition, luminance of the organic light emitting display device may be reduced by reducing an emission period T of the organic light emitting display device without reducing data voltages. Thus, a gamma distortion may be prevented. On the other hand, when the variation ΔSDATA of the sum-value SDATA is relatively great, the image sticking may be reduced, ideally eliminated, by changing an emission period T of the organic light emitting display device to the initial emission period T0. In addition, during a next frame, a new sum-value SDATA may be generated by summing image data of the next frame corresponding to the target locations, and the new sum-value SDATA may be stored (Step S440).

Although it is illustrated in FIG. 4 that the first through third check times t1 through t3, the first reduction emission period T1, the second reduction emission period T2, and the minimum emission period Tmin are used for the image sticking reduction algorithm, the number of check times and the number of emission periods are not limited thereto.

FIG. 5 is a block diagram illustrating a device in which an image sticking reduction algorithm of FIG. 4 is performed. Referring to FIG. 5, the device may include a data driver 510, a memory unit 530, a PWM controller 550, and a power supply unit 570.

Figure 5A:
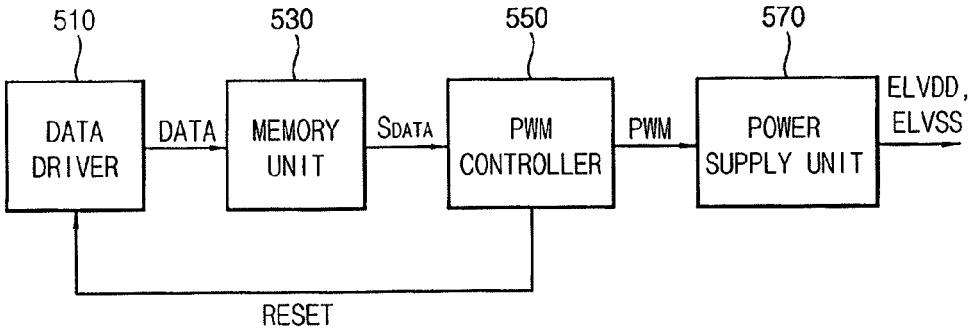
FIG. 5 is a block diagram illustrating a process in which an image sticking reduction algorithm of FIG. 4 is performed.
Figure 5B:
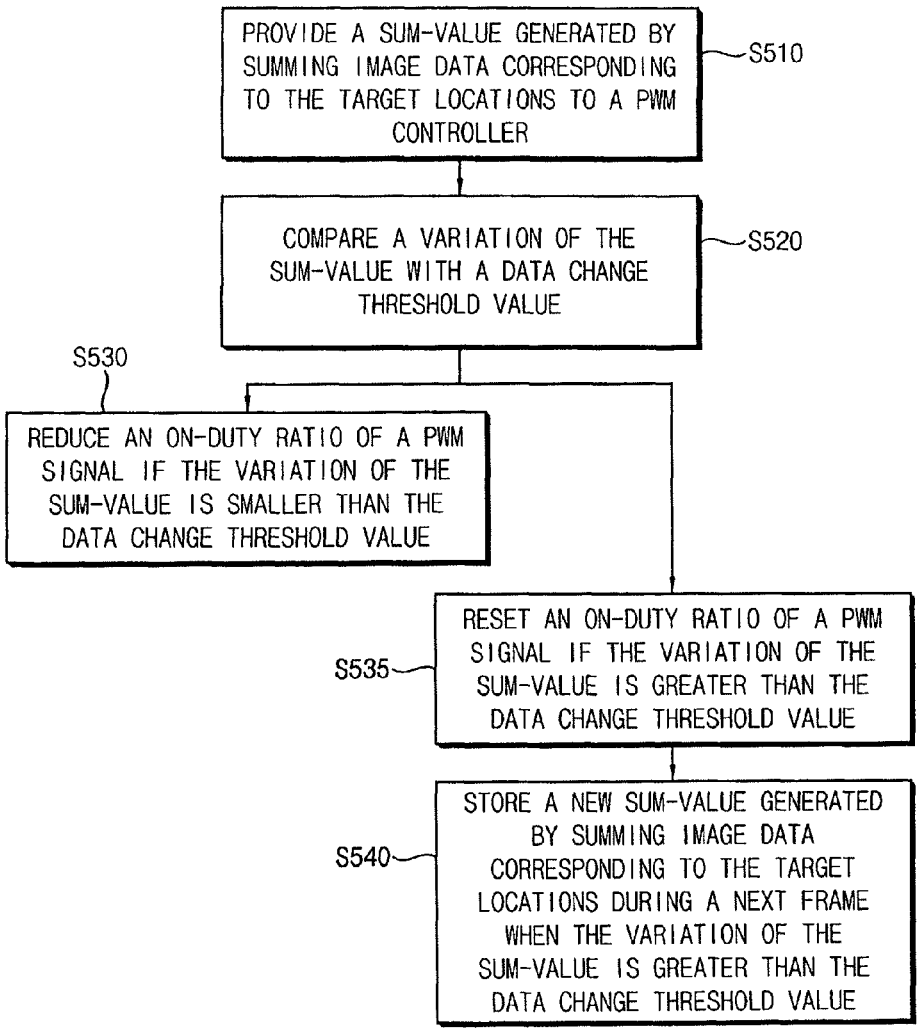

Referring to FIGS. 5A and 5B, the memory unit 530 may receive data signals (i.e., the image data) DATA corresponding to target locations from the data driver 510, the image sticking reduction algorithm being to be applied to the target locations. The memory unit 530 may generate the sum-value SDATA by summing the data signals DATA to provide the sum-value SDATA to a PWM controller 550 (S510). The PWM controller 550 may compare the variation ΔSDATA of the sum-value SDATA with the data change threshold value STH to generate a PWM signal PWM based on the comparison result (S520).

In detail, when the variation ΔSDATA of the sum-value SDATA is smaller than the data change threshold value STH, an on-duty ratio of the PWM signal PWM may be continuously reduced (S530). On the other hand, when the variation ΔSDATA of the sum-value SDATA is greater than the data change threshold value STH, an on-duty ratio of the PWM signal PWM may be reset to an initial on-duty ratio. Then, a reset signal RESET may be applied to the data driver 510 (S535). Next, during a next frame, the memory unit 530 may receive new data signals DATA corresponding to the target locations from the data driver 510 (S540).

The PWM controller 550 may provide the PWM signal PWM to the power supply unit 570. The power supply unit 570 may generate a first power voltage ELVDD and a second power voltage ELVSS based on the PWM signal PWM. In detail, a length of a low level period of the second power voltage ELVSS may be proportional to an on-duty ratio of the PWM signal PWM. In case of an organic light emitting display device employing a simultaneous emission technique, the low level period of the second power voltage ELVSS may be an emission period T of the organic light emitting display device. As described above, when the variation ΔSDATA of the sum-value SDATA is smaller than the data change threshold value STH, a length of the low level period of the second power voltage ELVSS may be reduced. As a result, a gamma distortion may be prevented by performing the image sticking reduction algorithm based on the PWM signal PWM. In addition, a phenomenon such as a flicker due to a low gray level and the like may be prevented.

Figure 6A:
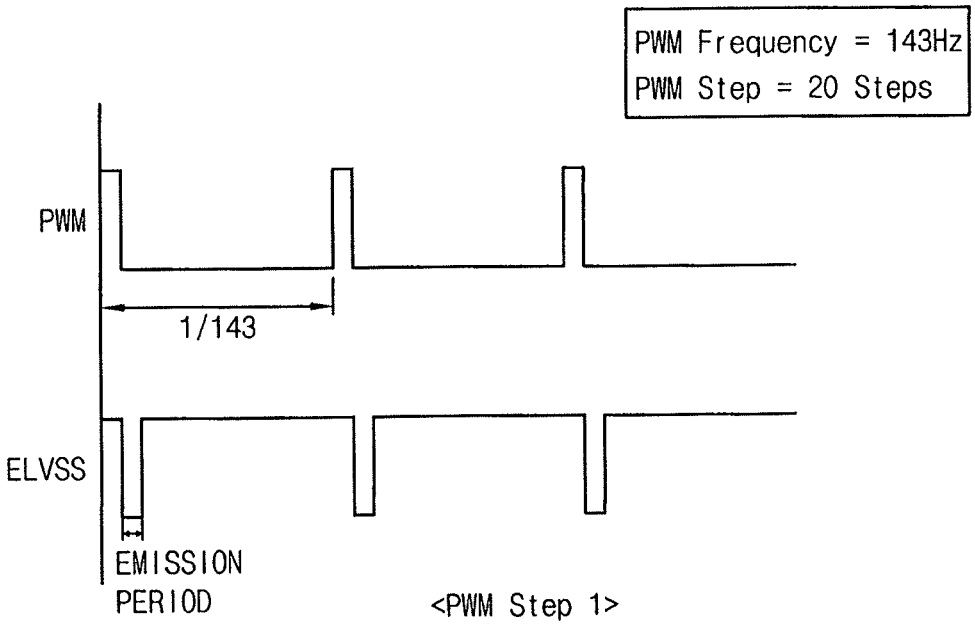
FIGS. 6A through 6C are diagrams illustrating a relation between a pulse width modulation (PWM) signal and a second power voltage.
Figure 6B:
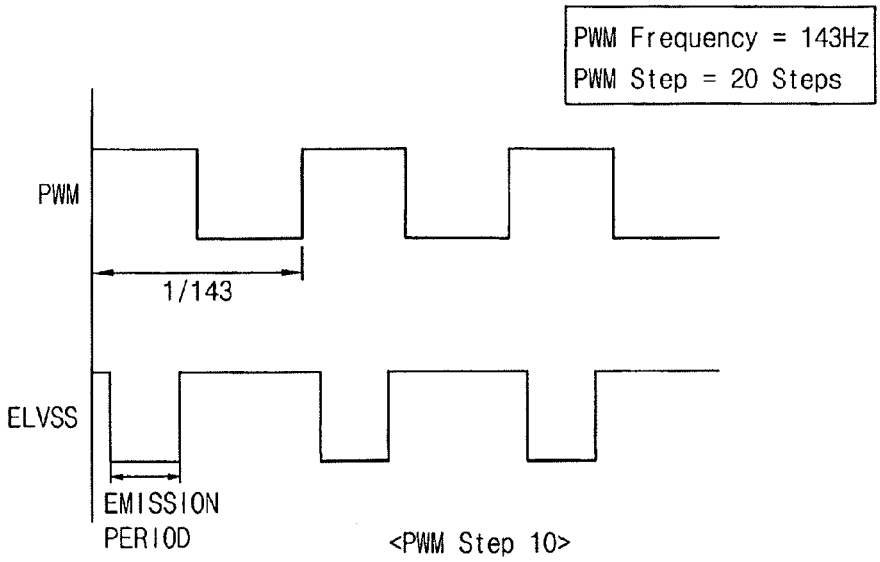
Figure 6C:
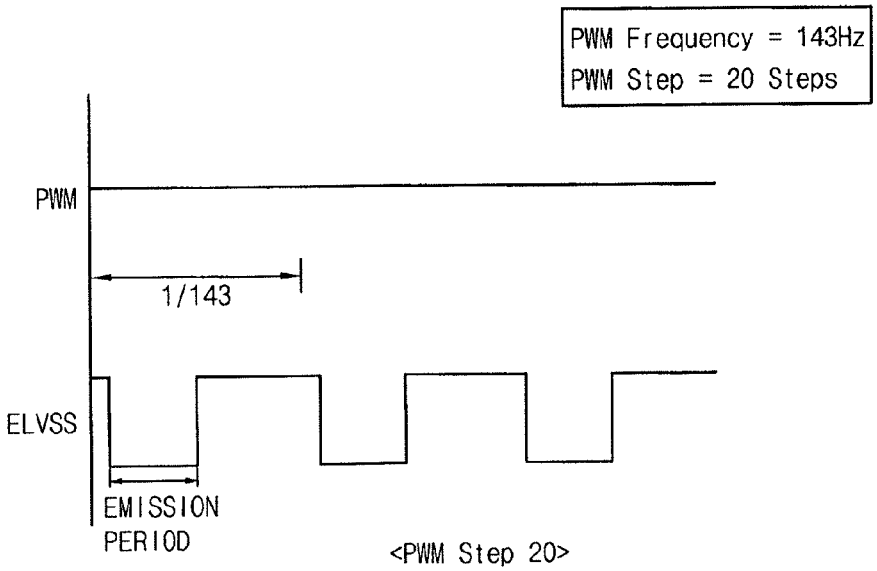

FIGS. 6A through 6C are diagrams illustrating a relation between a pulse width modulation (PWM) signal and a second power voltage.

A relation between the PWM signal PWM and the second power voltage ELVSS are illustrated in FIGS. 6A through 6C. Here, it is assumed that a frequency of the PWM signal PWM is 143 Hz, and an on-duty has 20 steps. In detail, FIG. 6A shows a relation between the PWM signal PWM having the on-duty of 1st step and the second power voltage ELVSS. FIG. 6B shows a relation between the PWM signal PWM having the on-duty of 10th step and the second power voltage ELVSS. FIG. 6C shows a relation between the PWM signal PWM having the on-duty of 20th step and the second power voltage ELVSS.

Referring to FIGS. 6A through 6C, an on-duty ratio of the PWM signal PWM is proportional to a length of a low level period of the second power voltage ELVSS. Thus, when a variation of the image data is relatively small, a length of the low level period of the second power voltage ELVSS may be reduced by reducing the on-duty ratio of the PWM signal PWM. As described above, an organic light emitting display device employing a simultaneous emission technique may emit light in the low level period of the second power voltage ELVSS. Thus, as a length of the low level period of the second power voltage ELVSS is reduced, luminance of the organic light emitting display device may be reduced. As a result, power consumption of the organic light emitting display device may be reduced.

Although it is illustrated in FIGS. 6A through 6C that the frequency of the PWM signal PWM is 143 Hz, and the on-duty has 20 steps, the present inventive concept is not limited thereto. In some example embodiments, the frequency of the PWM signal PWM and the number of steps of the on-duty may be variously determined.

Figure 7:
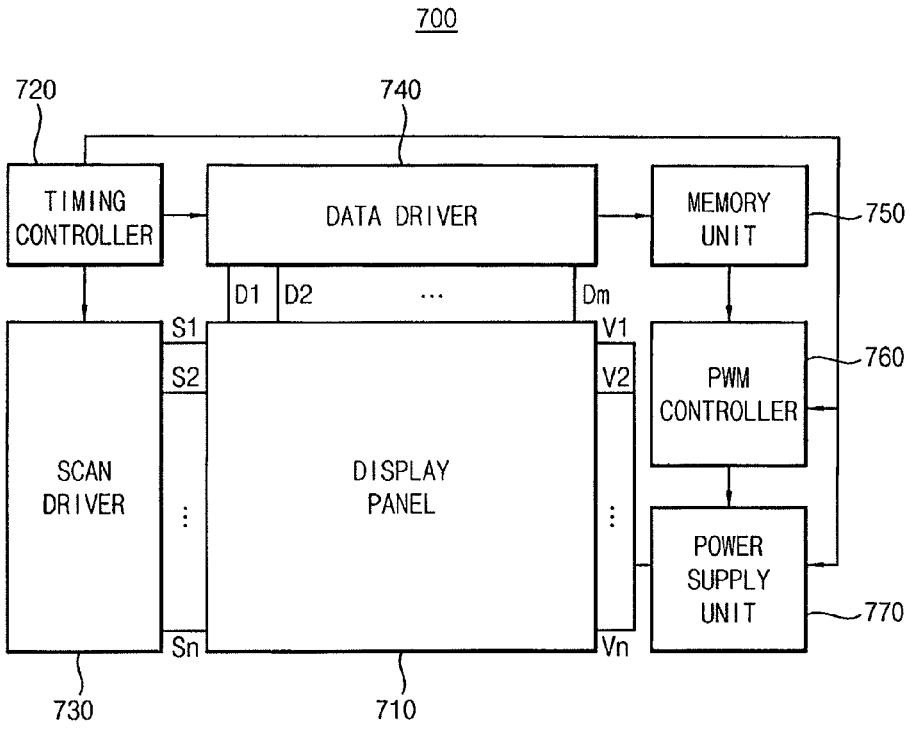
FIG. 7 is a block diagram illustrating an organic light emitting display device according to example embodiments.

FIG. 7 is a block diagram illustrating an organic light emitting display device according to example embodiments. Referring to FIG. 7, the organic light emitting display device 700 may include a display panel 710, a scan driver 730, a data driver 740, a memory unit 750, a PWM controller 760, a power supply unit 770, and a timing controller 720.

The display panel 710 may include a plurality of pixel circuits. The scan driver 730 may sequentially provide a scan signal to the pixel circuits via a plurality of scan-lines S1 through Sn. The data driver 740 may provide a data signal to the pixel circuits via a plurality of data-lines D1 through Dm according to the scan signal. The memory unit 750 may set target locations for reducing, ideally eliminating, image sticking based on images that are displayed on the display panel 710, and may store a sum-value that is generated by summing data signals (i.e., image data) corresponding to the target locations. The PWM controller 760 may generate a pulse width modulation (PWM) signal. Here, a duty ratio of the PWM signal may be determined based on comparison result, the comparison result being generated by comparing the sum-value with a data change threshold value. The power supply unit 770 may generate a first power voltage ELVDD and a second power voltage ELVSS to simultaneously provide the first power voltage ELVDD and the second power voltage ELVSS to the pixel circuits via a plurality of power-lines V1 through Vn. Here, a level of the first power voltage ELVDD and a level of the second power voltage ELVSS may be changed (i.e., between a high level and a low level) during one frame. The timing controller 720 may control the scan driver 730, the data driver 740, the PWM controller 760, and the power supply unit 770.

Meanwhile, a length of the low level period of the second power voltage ELVSS may be proportional to the on-duty ratio of the PWM signal. The pixel circuits simultaneously emit light in the low level period of the second power voltage ELVSS.

The memory unit 750 may include a frame memory device or a field programmable gate array (FPGA) for storing the data signals. For example, the frame memory device may be a memory device for storing information of display region of the organic light emitting display device 700. For example, the frame memory device or the FPGA may store information of display region of the organic light emitting display device. According to example embodiments, since the target locations for reducing sticking image is set, and then only data signals corresponding to the target locations are stored, only the data signals corresponding to the target locations may be stored in the frame memory device or in the FPGA without any additional memory device.

In one example embodiment, the target locations may be manually set by a user based on images that are displayed on the display panel 710. In another example embodiment, the target locations may be automatically set based on information related to color types of the images, information related to gradation levels of the images, information related to whether the images are still-images or moving-images, and/or other image characteristics.

As described above, an emission period of the organic light emitting display device 700 may be proportional to a length of the low level period of the second power voltage ELVSS. In addition, a length of the low level period of the second power voltage ELVSS may be proportional to the on-duty ratio of the PWM signal. When a variation of the sum-value is smaller than the data change threshold value, the PWM controller 760 may reduce the on-duty ratio of the PWM signal. As a result, an emission period of the organic light emitting display device 700 is reduced so that power consumption of the organic light emitting display device may be reduced. In addition, the data change threshold value may be a constant that is determined according to a type of the images displayed on the display panel 710. On the other hand, when a variation of the sum-value is greater than the data change threshold value, the PWM controller 760 may reset the on-duty ratio of the PWM signal to an initial on-duty ratio. In addition, the memory unit 750 may store a new sum-value by summing data signals corresponding to the target locations during a next frame. In this way, the organic light emitting display device 700 may repeat this process. Thus, the organic light emitting display device 700 of a large-screen organic light emitting diode (OLED) display may reduce power consumption, and may efficiently reduce, ideally eliminate, image sticking.

Figure 8:
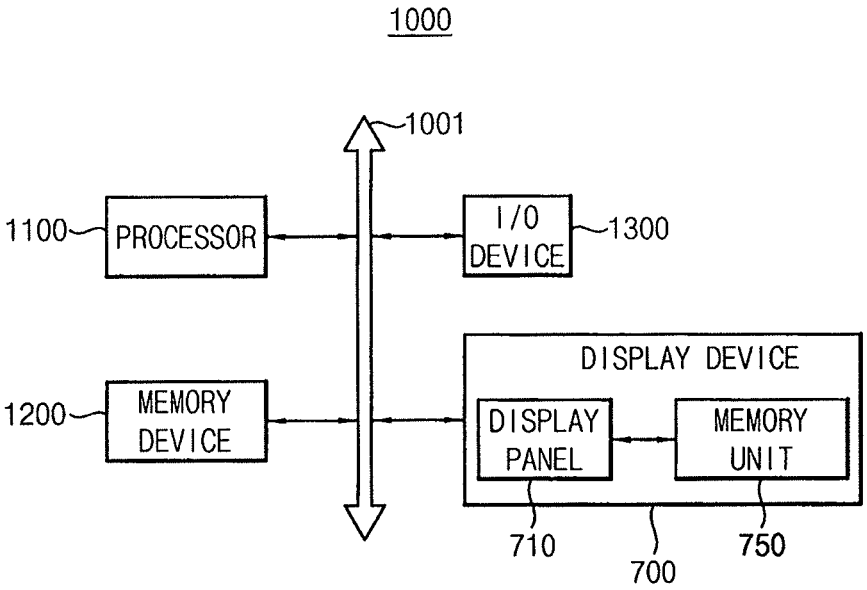
FIG. 8 is a block diagram illustrating an electric device having an organic light emitting display device of FIG. 7.

FIG. 8 is a block diagram illustrating an electric device having an organic light emitting display device of FIG. 7. Referring to FIG. 8, the electric device 1000 may include a processor 1100, a memory device 1200, an input/output (I/O) device 1300, and an organic light emitting display device 700. Here, the electric device 1000 may be a cellular phone, a smart phone, a smart pad, a television, a personal digital assistant (PDA), a MP3 player, a laptop, a computer, a digital camera, etc.

The processor 1100 may perform various computing functions. The processor 1100 may be a micro processor, a central processing unit (CPU), etc. The processor 1100 may be coupled to the memory device 1200 and the organic light emitting display device 700 via a bus 1001 such as an address bus, a control bus, a data bus, etc. Further, the processor 1100 may be coupled to an extended bus such as a peripheral component interconnection (PCI) bus.

The memory device 1200 may include at least one non-volatile memory device such as an erasable programmable read-only memory (EPROM) device, an electrically erasable programmable read-only memory (EEPROM) device, a flash memory device, etc, and/or at least one volatile memory device such as a dynamic random access memory (DRAM) device, a static random access memory (SRAM) device, etc. The memory device 1200 may store software that is performed by the processor 1100.

The I/O device 1300 may be an input device such as a keyboard, a keypad, a mouse, a touch screen, etc, and an output device such as a printer, a speaker, etc. The processor 1100 may control an operation of the I/O device 1300.

The organic light emitting display device 700 may be coupled to the processor 1100 via the bus 1001. The organic light emitting display device 700 may include the display panel 710 and the memory unit 750. As described above, the organic light emitting display device 700 may store image data in the memory unit 750, the image data corresponding to target locations to which an image sticking reduction algorithm is to be applied. In addition, the organic light emitting display device 700 may efficiently reduce, ideally eliminate, the image sticking caused in the organic light emitting display device 700, and may reduce power consumption by controlling an emission period of the organic light emitting display device based on a variation of the sum-value of the image data.

The present inventive concept may be applied to an electric device having an organic light emitting display device. For example, the present inventive concept may be applied to a television, a monitor, a laptop, a digital camera, a cellular phone, a smart phone, a smart pad, a PDA, a portable multimedia player (PMP), a MP3 player, a navigation system, a video phone, etc.

By way of summary and review, a method of setting target locations for reducing image sticking, and a method of driving an organic light emitting display device according to example embodiments may reduce, ideally eliminate, the image sticking without any gamma distortion, and may reduce power consumption by applying an image sticking reduction algorithm only to the target locations in which image sticking frequently occurs in the organic light emitting display device. In addition, an organic light emitting display device according to example embodiments may provide high-quality images with low power consumption.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of setting target locations for reducing image sticking, the method comprising:

acquiring a plurality of images of at least two of frames, each of the images being displayed during each frame by an organic light emitting display device and including a first portion image and a second portion image, the first portion image corresponding to the target locations;

determining the target locations in which image sticking frequently occurs by selectively comparing the first portion images of the at least two of frames; and storing image data corresponding to the target locations in a memory unit, wherein a plurality of pixel circuits simultaneously emit light in the organic light emitting display device, and wherein the image sticking infrequently occurs in the second portion image of each of the images.

2. The method of claim 1, wherein the target locations are manually set based on the images.

3. The method of claim 1, wherein the target locations are automatically set based on pixel information.

4. The method of claim 3, wherein the pixel information includes at least one of information related to color types of the images, information related to gradation levels of the images, and information related to whether the images are still-images or moving-images.

5. The method of claim 1, wherein the memory unit corresponds to a frame memory device or a field programmable gate array (FPGA).

6. A method of driving an organic light emitting display device for displaying a plurality of images, each of the images being displayed during each frame, the method comprising:

determining target locations in which image sticking frequently occurs by analyzing the plurality of images;

storing a sum-value that is generated by selectively summing image data corresponding to the target locations during one frame in a memory unit;

setting a data change threshold value;

comparing a variation of the sum-value with the data change threshold value;

reducing an emission period of the organic light emitting display device when the variation of the sum-value is smaller than the data change threshold value;

resetting the emission period of the organic light emitting display device when the variation of the sum-value is greater than the data change threshold value; and storing a new sum-value that is generated by summing image data corresponding to the target locations during a next frame in the memory unit after the emission period of the organic light emitting display device is reset.

7. The method of claim 6, wherein reducing the emission period of the organic light emitting display device reduces power consumption of the organic light emitting display device.

8. The method of claim 7, wherein resetting the emission period includes resetting the emission period to an initial emission period.

9. The method of claim 8, wherein reducing the emission period of the organic light emitting display device includes:

setting a first check time, a second check time, a third check time, a first reduction emission period, a second reduction emission period, and a minimum emission period, the first check time being greater than the second check time, the second check time being greater than the third check time, the initial emission period being greater than the first reduction emission period, the first reduction emission period being greater than the second reduction emission period, the second reduction emission period being greater than the minimum emission period;

changing the emission period of the organic light emitting display device to the first reduction emission period when the variation of the sum-value is smaller than the data change threshold value for the first check time;

changing the emission period of the organic light emitting display device to the second reduction emission period when the variation of the sum-value is smaller than the data change threshold value for the second check time; and changing the emission period of the organic light emitting display device to the minimum reduction emission period when the variation of the sum-value is smaller than the data change threshold value for the third check time.

10. The method of claim 9, wherein the emission period of the organic light emitting display device is proportional to a length of a low level period of a second power voltage that is provided to the organic light emitting display device, and wherein a length of the low level period of the second power voltage is controlled by a pulse width modulation (PWM) signal.

11. The method of claim 10, further comprising comparing a variation of the new sum-value with the data change threshold value during the next frame when the variation of the sum-value is greater than the data change threshold value during the one frame.

12. An organic light emitting display device, comprising:

a display panel having a plurality of pixel circuits;

a scan driver to sequentially provide a scan signal to the pixel circuits via a plurality of scan-lines;

a data driver to provide a data signal to the pixel circuits via a plurality of data-lines based on the scan signal;

a memory unit to set target locations for reducing image sticking based on a plurality of images that are displayed on the display panel, and to store a sum-value generated by selectively summing image data corresponding to the target locations during each frame;

a PWM controller to generate a pulse width modulation (PWM) signal, an on-duty ratio of the PWM signal being determined based on a comparison result generated by comparing a variation of the sum-value with a data change threshold value;

a power supply unit to generate a first power voltage and a second power voltage to simultaneously provide the first power voltage and the second power voltage to the pixel circuits; and a timing controller to control the scan driver, the data driver, the PWM controller, and the power supply unit, wherein a length of a low level period of the second power voltage is proportional to the on-duty ratio of the PWM signal, and wherein the pixel circuits simultaneously emit light in the low level period of the second power voltage.

13. The device of claim 12, wherein the target locations are manually set based on the images, or automatically set based on pixel information, and wherein the pixel information includes at least one of information related to color types of the images, information related to gradation levels of the images, and information related to whether the images are still-images or moving-images.

14. The device of claim 13, wherein an emission period of the organic light emitting display device is proportional to a length of the low level period of the second power voltage.

15. The device of claim 14, wherein the PWM controller reduces the on-duty ratio of the PWM signal when the variation of the sum-value is smaller than the data change threshold value.

16. The device of claim 15, wherein the PWM controller resets the on-duty ratio of the PWM signal to an initial on-duty ratio when the variation of the sum-value is greater than the data change threshold value.

17. The device of claim 16, wherein the memory unit stores a new sum-value generated by summing image data corresponding to the target locations during a next frame when the variation of the sum-value is greater than the data change threshold value.

18. The device of claim 17, wherein the data change threshold value corresponds to a constant that is determined according to a type of the images displayed on the display panel.

19. The device of claim 18, wherein the memory unit corresponds to a frame memory device that stores the image data for the display panel.

20. The device of claim 19, wherein luminance of the display panel is reduced when the emission period of the display panel is reduced.

* * * * *